United States Patent [19]

Wright

[11] Patent Number: 5,056,453

[45] Date of Patent: Oct. 15, 1991

[54] APPARATUS FOR SELF-RIGHTING A RIGID INFLATABLE BOAT

[76] Inventor: Derek Wright, 962 Plymouth Place, North Vancouver, B.C., Canada, V7H 2J2

[21] Appl. No.: 584,513

[22] Filed: Sep. 18, 1990

Related U.S. Application Data

[63] Continuation-in-part of Ser. No. 479,950, Feb. 14, 1990, abandoned.

[51] Int. Cl.[5] ..... B63B 7/08

[52] U.S. Cl. ..... 114/345; 441/40

[58] Field of Search ..... 114/345; 441/40

[56] References Cited

U.S. PATENT DOCUMENTS

| | | | |
|---|---|---|---|
| 3,054,124 | 9/1962 | Silverstone | 9/11 |
| 3,268,925 | 8/1966 | Serra | 9/11 |
| 4,001,905 | 1/1977 | Givens | 9/11 |

FOREIGN PATENT DOCUMENTS

| | | | |
|---|---|---|---|
| 527063 | 7/1958 | Canada . | |
| 109308 | 4/1968 | Denmark | 441/40 |
| 2411425 | 9/1975 | Fed. Rep. of Germany | 114/345 |
| 864382 | 4/1961 | United Kingdom . | |
| 1511243 | 5/1978 | United Kingdom | 114/345 |

OTHER PUBLICATIONS

Specifications (2 sheets) for Zodiac Hurricane No. 64010 of Hurricane Marine Co., of Richmond, British Columbia, Canada.

*Primary Examiner*—Sherman Basinger
*Assistant Examiner*—Thomas J. Brahan
*Attorney, Agent, or Firm*—Glenn D. Bellamy

[57] ABSTRACT

An apparatus for self-righting a rigid inflatable boat in which the boat includes an elongated hull having a determinable center of gravity and beam width. The boat hull has an elongated rigid bottom and inflatable sidewalls which have top, bottom and inner edges. An inflatable arch member having first and second leg portions extending upwardly and inboard from opposite sidewalls of the hull converges at a central point spaced outwardly a first predetermined vertical distance above the top edges. The first predetermined distance is at least equal to the sum of one-half of the beam of the hull, plus a distance equal to the vertical distance, if any, at which the center of gravity may be located above the sidewalls' bottom edges. Each leg portion has an axial centerline which extends upwardly and inwardly substantially between its respective sidewall and the central point. Each axial centerline passes vertically above the inner edge of its respective sidewall at a vertical level above the bottom edge a distance equal to at least one-half of the vertical distance between the central point and the bottom edge. The inflatable arch member is sized to have an overall width substantially not greater than the beam of the boat and to provide a total displacement sufficient to lift the boat. The arch member is positioned along the elongated boat hull aft of the center of gravity.

8 Claims, 5 Drawing Sheets

APPARATUS FOR SELF-RIGHTING A RIGID INFLATABLE BOAT

RELATED APPLICATIONS

This application is a continuation-in-part of my copending application Ser. No. 07/479,950, filed Feb. 14, 1990, now abandoned.

DESCRIPTION

1. Technical Field

This invention relates to an inflatable apparatus for self-righting a rigid inflatable boat of a type having an elongated rigid bottom and inflatable sidewalls, and in particular to such an apparatus which will reliably self-right the boat from a capsized position upon initial inflation as well as after inflation.

2. Background Art

Rigid inflatable boats (RIBs) have been used for many years as the vessel of choice by the military, Coast Guard, or private industry for rescue, research, or as a dinghy. Generally, a RIB comprises a rigid bottom, usually made of wood, metal or fiberglass, connected around its bow and side edges to inflatable sidewall chambers. Typically, it includes a rigid stern which is attached to or integral with the solid bottom. Commonly, the RIB's waterline is at the connection between the solid bottom and inflatable sidewalls such that the inflated chambers make up the freeboard portion of the boat.

RIBs are particularly suited for rescue and research work, or as a dinghy for a larger vessel, because they are lightweight, and relatively inexpensive. A RIB combines the benefits of a solid-bottom boat with the benefits of an inflatable raft. The solid bottom provides a smooth exterior hull for stable high speed traveling through water, as well as providing its occupants with a solid floor for sure footing and for the mounting of onboard equipment. The inflatable sidewalls provide some cushioning for contact between the RIB and other objects in the water, and prevent the boat from sinking, even if swamped. RIBs come in a variety of sizes ranging from six feet to twenty-eight feet, or longer. A RIB may be equipped with an outboard motor supported by a rigid stern or may be rigged with an inboard or stern-drive motor. Other equipment including lights, electronics, or lifts may be added, as desired, depending upon the use for which the RIB is intended. Such RIBs are manufactured in North America by POLARIS and ZODIAC, both of British Columbia; Canada.

Because RIBs are often used for marine research or Coast Guard rescue, they are often subjected to adverse sea conditions, including high winds and waves. Consequently, although the boats will not sink due to the buoyancy of the sidewalls, they are subject to being capsized. Once capsized, they may be difficult to right, especially if heavily equipped.

Recognizing this as a problem, a prior attempt to make a RIB self-righting included the mounting of an inflatable bag on a rigid transom near the stern of the boat. Generally, a transom is a rigid structure having upwardly-extending vertical members connected by a horizontal member at their upper ends. The transom is generally the width of the interior beam of the boat and may rise about five feet or so above the deck. An inflatable bag, shaped substantially like a horizontally-positioned cylinder, was attached to the upper side of the transom's horizontal member. The bag extended approximately the full beam of the boat and was of sufficient diameter to provide displacement buoyancy adequate to lift the equipped rib, typically about 42 to 48 inches in diameter In some instances, one end of the inflatable chamber would be slightly enlarged to create asymmetric buoyancy.

While this device could often right an overturned RIB upon initial inflation, it was not completely reliable and had other inherent deficiencies which caused the device to be an inadequate solution. For example, the RIB may not be self-righted because, while the inflated chamber would lift the stern end of the boat above the water, it would sometimes be held balanced in that overturned position, with the relatively wide inflated chamber and the inflated bow of the boat resting on the surface of the water. Also, once inflated, the device would usually not self-right the RIB upon subsequent capsizing, but rather allow the boat to remain on its side on the surface of the water. Both of these problems could be attributed to the fact that this system relied partially upon the roll momentum which would hopefully be created upon initial inflation to move the boat to a completely uprighted position. Another problem with this device was the potential for grounding in a capsized position in shallow water. In very shallow water, it was possible that, whether the air chamber was inflated or deflated, the rigid transom or inflated air chamber would rest on the bottom, preventing the boat from being righted, even manually. Additionally, after righting, the size of the inflated bag created significant and undesirable wind resistance, requiring that the bag be immediately deflated or risk subjecting the boat to the potential of being overturned or hindered by forceful winds.

SUMMARY OF THE INVENTION

The present invention provides an apparatus which reliably self-rights a rigid inflatable boat upon initial inflation after capsizing and will reliably prevent the boat from capsizing again. The apparatus is usable with a RIB having an elongated boat hull with a determinable center of gravity. The hull has an elongated rigid bottom and inflatable sidewalls, as previously described, with top, bottom and inner edges. The rigid bottom is connected to the inflatable sidewalls substantially along the bottom edges. The apparatus includes an inflatable arch member having first and second leg portions which extend upwardly and inboard from opposite sidewalls of the hull and converge at a central point spaced vertically upwardly a first predetermined distance above the sidewall top edges. This first predetermined distance is at least equal to the sum of one-half of the outermost beam, or width, of the hull, plus a distance equal to the vertical distance, if any, at which the center of gravity may be located above the sidewalls' bottom edges. Each leg portion has an axial centerline which extends upwardly and inwardly substantially between the respective sidewall from which it extends and the upwardly-spaced central point. Each axial centerline also passes through a point which is substantially vertically above the inner edge of the sidewall and which is spaced vertically above the sidewall's bottom edges a distance at least equal to one-half of the vertical distance between the central point and the bottom edge. The inflatable arch member is sized to have an overall width substantially not greater than the beam of the boat and to provide buoyancy sufficient to lift the boat.

The arch member is positioned along the elongated boat hull aft of the center of gravity.

In preferred form, the inflatable arch member is relatively pointed, intersecting at an acute angle at its top, and each leg is slightly outwardly bent at a predetermined point between the peak of the arch and the sidewalls of the boat. These bends may be asymmetric in order to encourage a more rapid roll of the boat into an upright position toward one side or the other. Such asymmetry is not necessary, however, as the present invention does not rely upon roll momentum to right the boat.

In order to provide rigidity to the inflatable arch member and so that it will quickly begin to take shape when being inflated under the water prior to full inflation, a rigid frame supported by the rigid bottom of the boat may be provided.

Preferred embodiments of the present invention may be designed according to specific geometric parameters for predetermined or existing RIB hull designs. Specific preferred embodiments will be described below relating to RIBs in which the interior distance between the inflatable sidewalls is either greater or less than 52% of the beam (distance between exterior edges of the inflatable sidewalls).

Other important aspects and features of the present invention may be noted upon reference to the accompanying drawings and description of the applicant's best-known mode of carrying out the invention, both of which are to be considered part of the disclosure of the present invention.

BRIEF DESCRIPTION OF THE DRAWINGS

Like reference numerals are used to denote like parts throughout the various figures of the drawing, wherein.

BEST MODE FOR CARRYING OUT THE INVENTION

Figure 1:
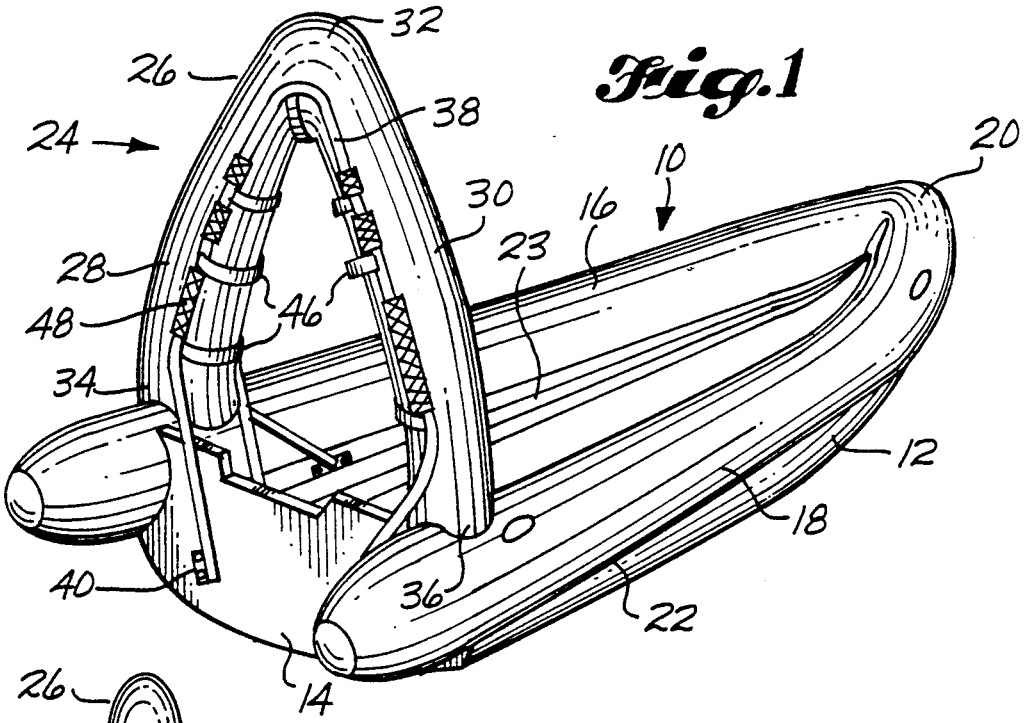
FIG. 1 is a pictorial view of a rigid inflatable boat which includes the self-righting apparatus of the present invention shown in an inflated condition.
Figure 3:
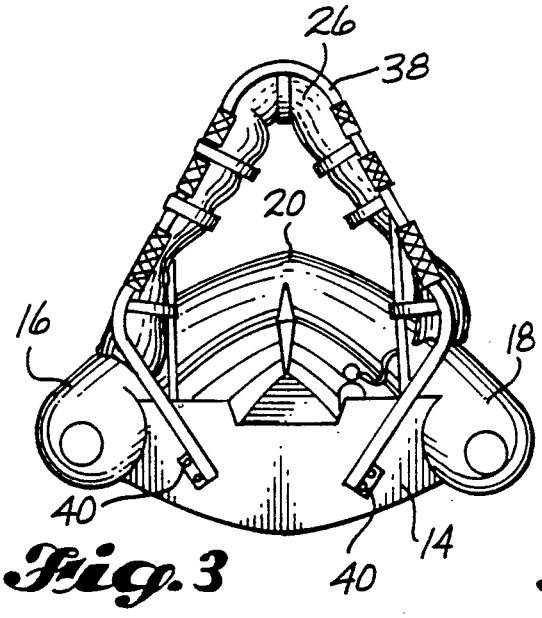
FIG. 3 is a stern view of the boat with the self-righting apparatus shown in a deflated condition.

Referring to the various figures of the drawing, and first to FIGS. 1 and 3, therein is shown at 10 a rigid inflatable boat (RIB) of typical construction. The RIB includes an elongated rigid bottom portion 12 and a rigid stern portion 14 which is secured thereto or formed integral therewith. The sidewalls 16, 18 are inflatable chambers which meet at the bow end 20 of the RIB and are secured along their bottom edges 22 to the rigid portion 12 of the hull. In practice, the RIB's waterline is usually at the lower edge 22 of the sidewalls 16, 18 at this connection, except that the bow 20 may be slightly upwardly turned. In this manner, the depth of the rigid bottom 12 constitutes the draft of the boat 10 and the inflatable sidewalls 16, 18 make up the freeboard of the boat 10. The RIB may also include a rigid deck 23 or floor which is usually also at about the level of the lower edge 22 of the sidewalls 16, 18 to provide a flat inner working surface for the RIB. The RIB 10 may also include an inboard, outboard, or stern-drive motor (not shown), as well as other equipment specific for its intended use.

In use, a RIB may be subjected to conditions causing it to overturn. Because its shear line (plane which extends substantially along the upper edges of the sidewalls 16, 18) is relatively flat, an overturned RIB will lie substantially flat with the upper edges of the sidewalls 16, 18 on the surface of the water. The present invention provides an inflatable apparatus 24 which extends upwardly from the sidewalls 16, 18 of the RIB 10 which will quickly and reliably self-right the boat 10 and, after inflation, will prevent the boat 10 from subsequently capsizing.

Figure 4:
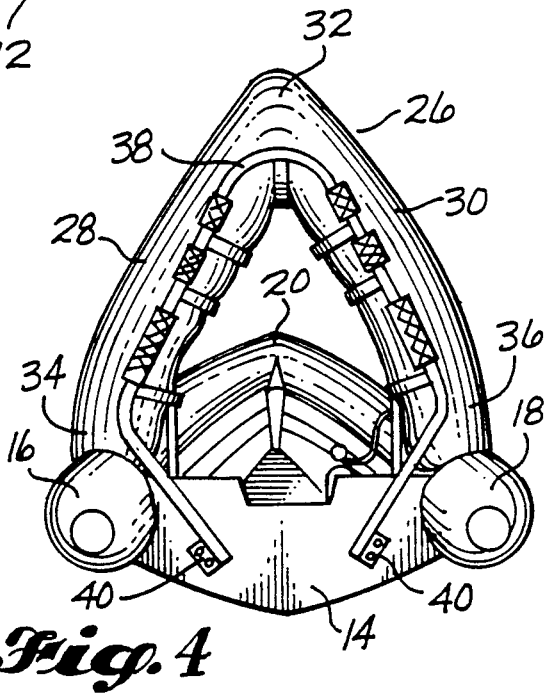
FIG. 4 is a stern view of the boat with the self-righting apparatus shown in an inflated condition.
Figure 5:
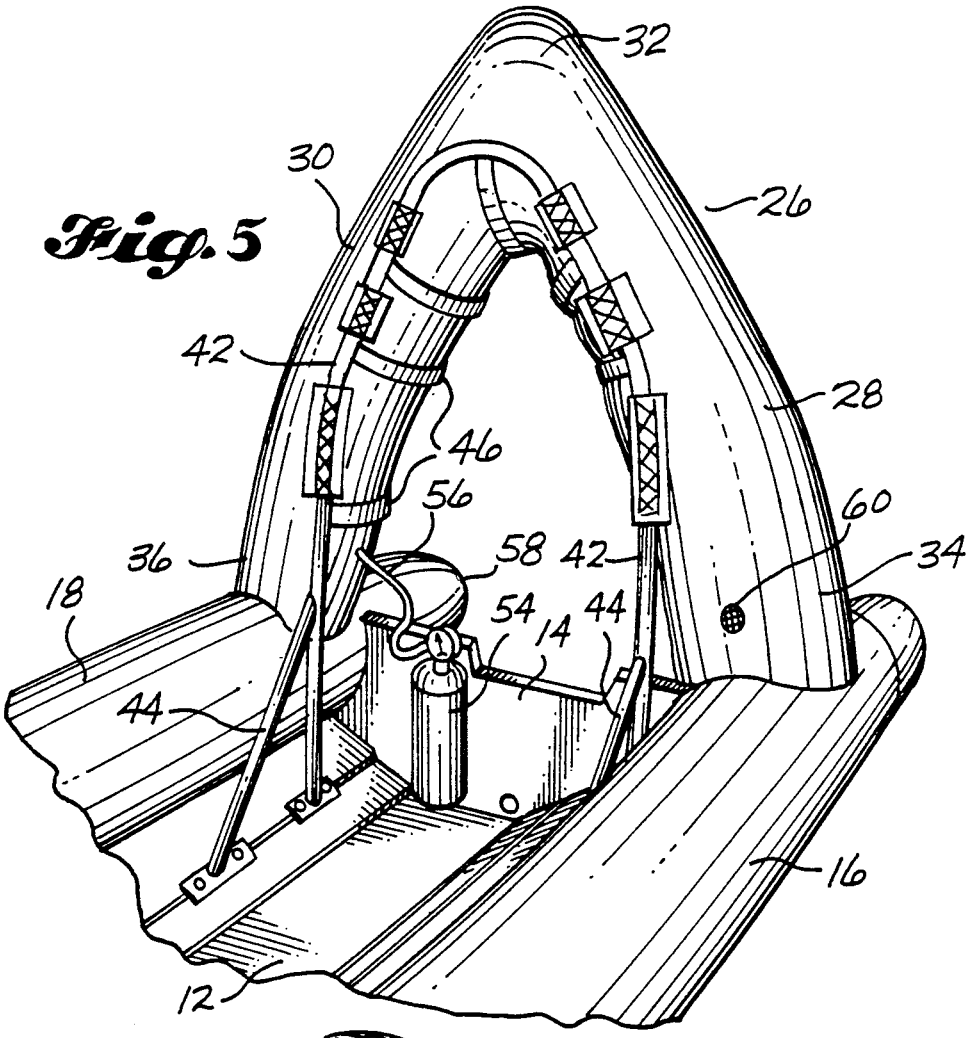
FIG. 5 is a fragmentary pictorial view of the self-righting apparatus, detailing the attachment of the support structure to the rigid hull of the boat.

In preferred form, the apparatus 24 includes an arch-shaped tubular member 26 made of a flexible rubberized material which may be gas inflated. Referring now also to FIGS. 4 and 5, the arch member 26 has a pair of outwardly bent legs 28, 30 which converge at an acute angle at an upper central portion 32. The leg portions 28, 30 extend downwardly substantially to upper edges of the sidewalls tubes 16, 18. The lower ends 34, 36 of the legs 28, 30 may be shaped to curve around the sidewalls 16, 18. Although the gas-inflatable chamber of the arch member 26 is not in communication with the gas-filled chambers of the sidewalls 16, 18, the lower portions 34, 36 of the arch member 26 may, however, be in contact with or closely spaced from the sidewalls 16, 18. Although not necessary to the operation of the present invention, it is preferred that the lower end portions 34, 36 are so shaped to add stability and prevent undesired inward or outward movement of the leg portions 28, 30 when inflated. It should be noted that the invention is completely operable with the lower ends of the leg portions 28, 30 bluntly shaped.

Between the upper central portion 32 and lower end portions 34, 36, the leg portions 28, 30 are bowed or bent outwardly a predetermined distance at a predetermined vertical level. The exact calculations for determining the size, shape and position of the arch member 26 will be described later in detail.

The self-righting apparatus 24 may be supported in a deflated condition (FIG. 3) as well as its inflated condition, by a rigid frame which is mounted to the rigid bottom 12 and/or stern 14. The frame includes a rear portion 38 which is mounted (as at 40) to the stern 14. The frame also includes a forward portion 42 which is mounted slightly forward of the stern 14 to the rigid bottom 12 and may include forwardly-angled braces 44. The frame includes curved cross members 46 which bridge between the rear and forward frame portions 38, 42 and are shaped to receive the inflated leg portions 28, 30. The forward and rear frame portions 38, 42, including the forward braces 44, are preferably made of tubular aluminum or other non-corrosive metal and may be about two inches in diameter. The cross members 46 may be made from flat aluminum stock about two inches wide, bent to receive the inflatable arch member 26 and welded at opposite ends to the rear and forward frame portions 38, 42. Although aluminum is the preferred material for construction of the frame, steel, stainless steel, wood or fiberglass could be selected, as desired, for construction of the transom or arch-supporting frame.

Figure 2:
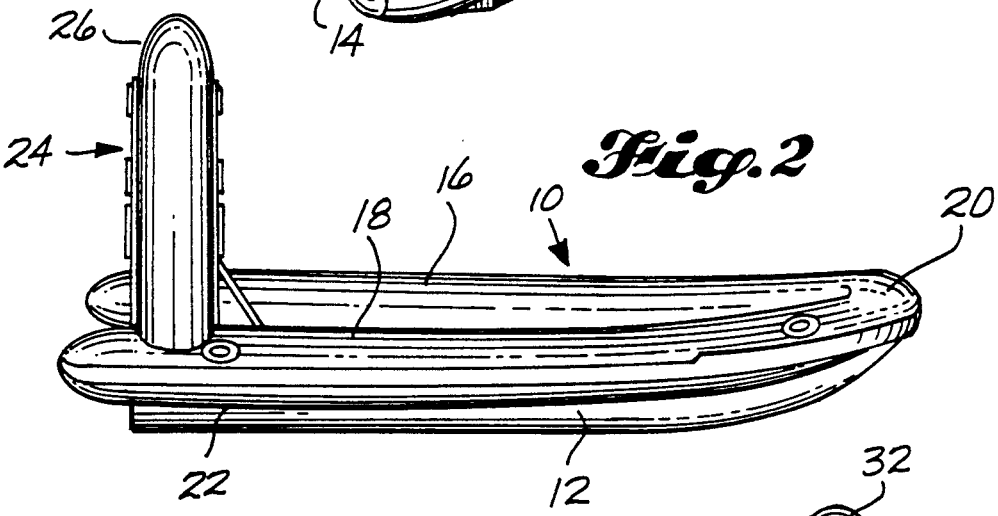
FIG. 2 is a starboard side view of the boat.

The purpose of the transom frame is to support the inflatable arch member 26 in a position substantially perpendicular to the length of the boat 10, as best shown in FIG. 2. In this manner, the inflatable arch member 26 will be supported against folding or bending under the weight of the boat 10 and equipment thereon. The main function of the inflatable arch member 28 is floatation and is not, of itself, considered to provide a transom structure. While the inflatable arch could be constructed to be self-supporting, such construction is not presently considered to be cost-effective. Additionally, as will be discussed in further detail below, the pre-inflation position of the arch member 26 assisted by the support frame aids in a more rapid righting of the boat 10 upon inflation of the apparatus 24. The rear and forward frame portions 38, 42 are shaped to generally conform with that of the inflatable arch member 26 with lower ends being positioned as necessary for proper mounting.

Figure 6:
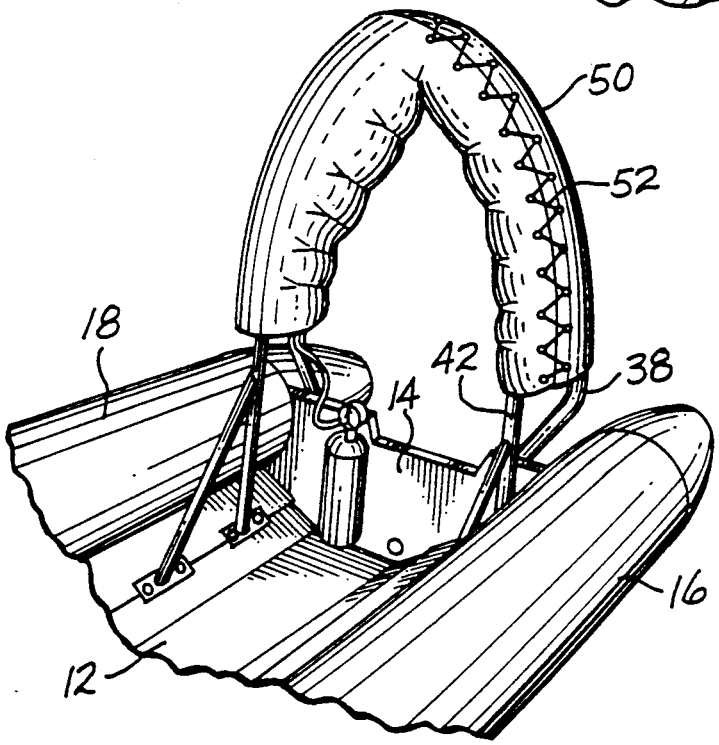
FIG. 6 is a fragmentary pictorial view showing the self-righting apparatus in a deflated condition with a protective cover in place.

The inflatable arch member 26 is attached to the rear and forward frame portions 38, 42 as by lacing 48 or lashing in a well-known manner through eyes attached to the arch 26. This allows the arch member 26 to be held in proper position in both the inflated and deflated conditions. Referring to FIG. 6, the inflatable arch member 26 may be protected during times of non-use from severe weather conditions, such as exposure to sunlight or ice, by a protective cover 50. In preferred form, the protective cover 50 is wrapped over the support frame around the deflated arch member 26 and is overlapped along an outer edge. The lower end portions 34, 36 of the arch 26 are folded upwardly when deflated to be enclosed by the cover 50. The cover 50 is then laced together, as through eyelets, with a cord 52 having a predetermined break strength, such as, for example, fifty pounds. Upon inflation of the arch member 26, the break strength of the cord 52 would be exceeded, causing the cover 50 to lay open without interfering with proper inflation of the arch member 26. Of course, many other ways of attaching a releasable cover could be utilized in conjunction with the present invention.

The arch member 26 is inflated with compressed gas such as carbon dioxide or air which is kept in an on-board cylinder or tank 54. The gas cylinder 54 may be mounted to the stern 14, rigid bottom 12, or support frame members 38, 42, 44 so that it may be held securely and safely when not in use. The cylinder 54 is operably connected through a delivery hose 56 to the inflatable chamber of the arch member 26. As will be discussed in detail below, it may be desired that the delivery hose 56 introduce compressed gas into the arch member 26 at a particular location, such as one of the lower ends 34, 36 of the arch leg portions 28, 30. Release of the gas from the cylinder 54 may be accomplished manually, as by a pull cord 58, or automatically, as by a position sensor (not shown) of a well-known type which would activate release of inflation gas from the cylinder 54 upon movement of the boat 10 beyond 90° of roll from normal. Typically, the gas reservoir tank or cylinder 54 will contain slightly more compressed gas than will be needed to completely inflate the arch member 26. To prevent overinflation for this or any other reason, a pressure relief valve 60 may be provided in the inflatable arch member 26.

Figures 7, 8, 9, 10:
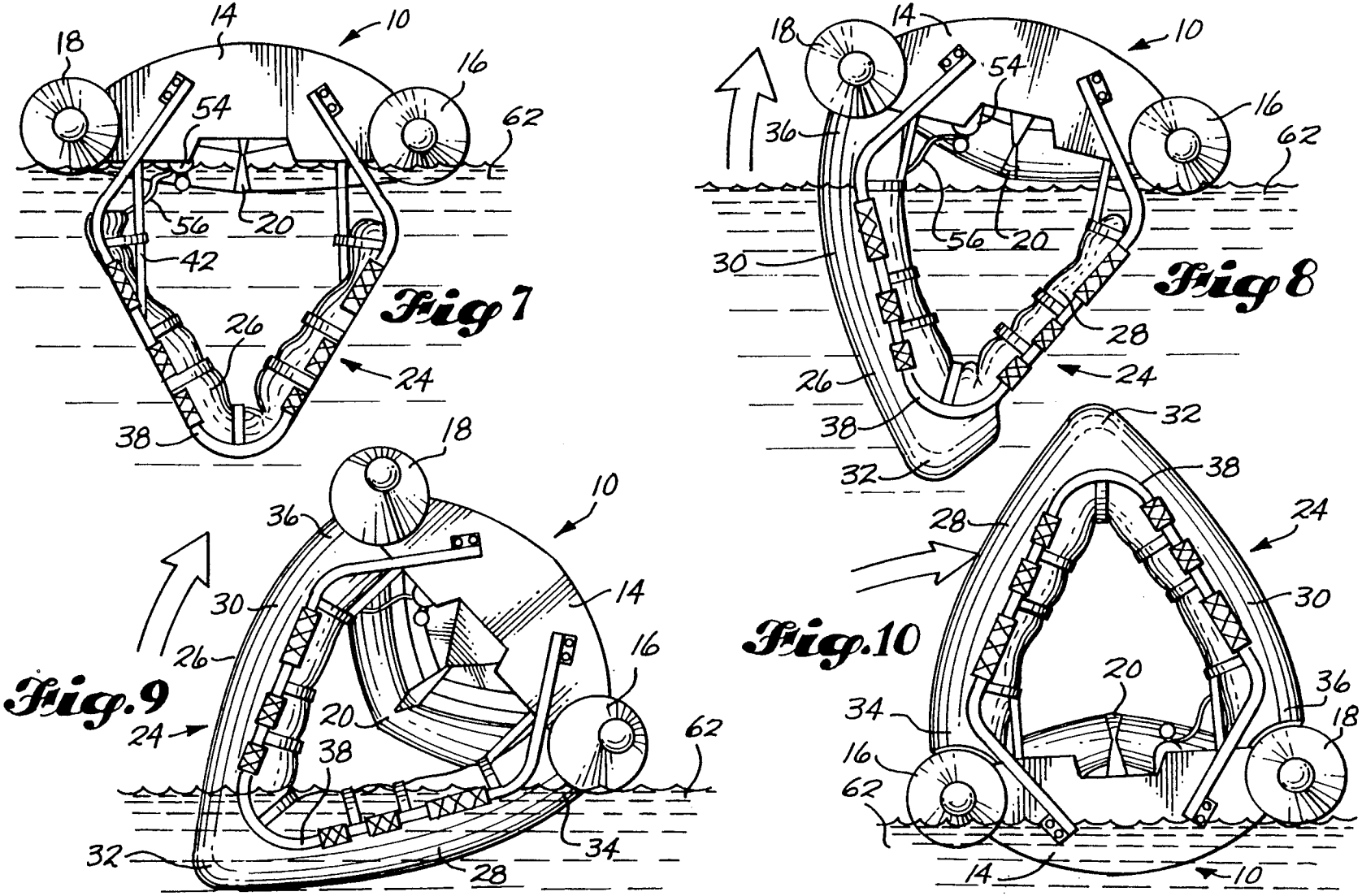
FIGS. 7–10 are sequential views showing inflation of the self-righting apparatus in an inverted boat and subsequent turning and righting of the craft.

Referring now to FIGS. 714 10, therein is shown the boat 10 including the self-righting apparatus 24 of the present invention in various positions between fully capsized and substantially righted. The optional cover 50 is not shown in these figures in order to provide clarity and so as not to conceal detail. Referring first to FIG. 7, the boat 10 is shown in a fully-capsized position, floating with the upper edges of the inflatable sidewalls 16, 18 resting on the surface of the water 62. In this position, the support frame 38, 42 is projecting downwardly into the water 62. The inflatable arch member 26 is shown in a completely deflated condition.

In general, inflation of the inflatable arch member 26 is affected in the following steps. Referring next to FIG. 8, water is displaced as compressed gas from the tank 54 is released into the arch member 26. Because of the substantially U- or V-shape of the arch member 26 in this position, one leg portion 30 will begin to inflate prior to the other 28, unless the inflation gas enters the arch member 26 at or near the central portion 32. As water is displaced by the inflating leg portion 30, one side (shown starboard) of the boat 10 will be lifted, as shown by the movement arrow in FIG. 8. This lifting force will cause the boat 10 to roll onto the opposite inflatable sidewall 16.

Referring to FIG. 9, as the arch member 26 continues to inflate and further displace water 62, the boat 10 will continue to roll onto the inflated sidewall 16, lifting the center of gravity further toward a position directly over the longitudinal axis of the sidewall 16. Because of the outward bow of each leg portion 28, 30, the boat hull will continue to be lifted upon further inflation, as indicated by the movement arrow in FIG. 9, creating a moment arm of buoyancy force sufficient to cause the boat 10 to topple into an upright position, as shown in FIG. 10. As shown, this is accomplished without any portion of the arch member 26 extending beyond the beam of the boat 10. This self-righting movement also acts to substantially bail the boat hull, allowing water to run out as it is turned from an angled position, as shown in FIG. 9, to an upright position.

It should be noted that regardless of the exact manner in which the arch member 26 inflates, the apparatus 24 will reliably self-right the boat 10. The present invention positions the displacement of the leg portions 28, 30 of the arch member 26 such that the boat 10 will self-right in the above-described manner even if both leg portions 28, 30 are inflated simultaneously. This is because the present invention does not rely upon roll momentum to right the boat 10, although roll momentum which may be created by asymmetric inflation can facilitate increased speed of self-righting. The upwardly-pointed shape of the arch member 26 does not allow the boat 10 to be supported in an inverted position.

Figure 11:
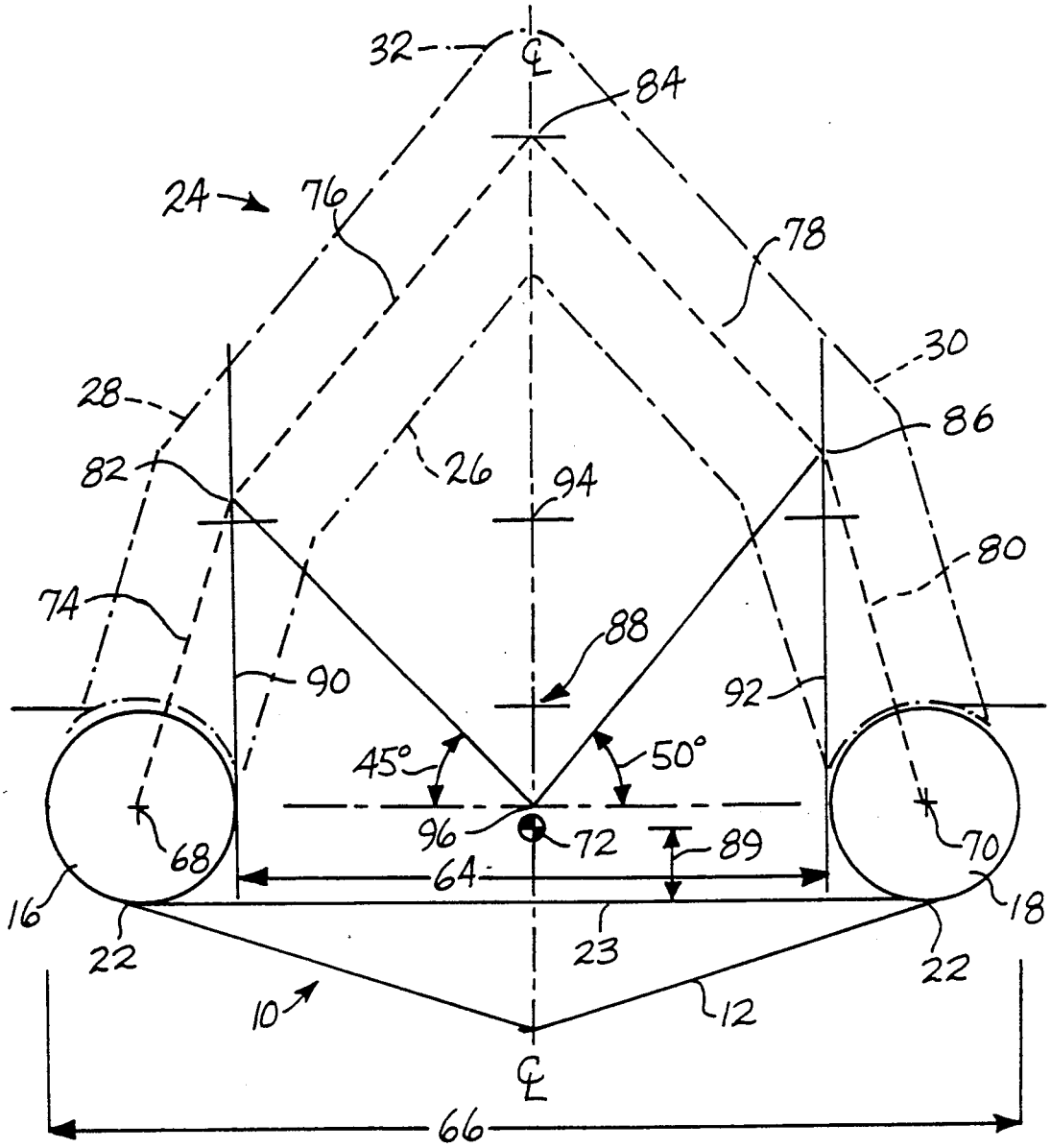
FIG. 11 is a cross-sectional schematic representation illustrating the angular specifications employed in construction of a first embodiment of the invention.
Figure 12:
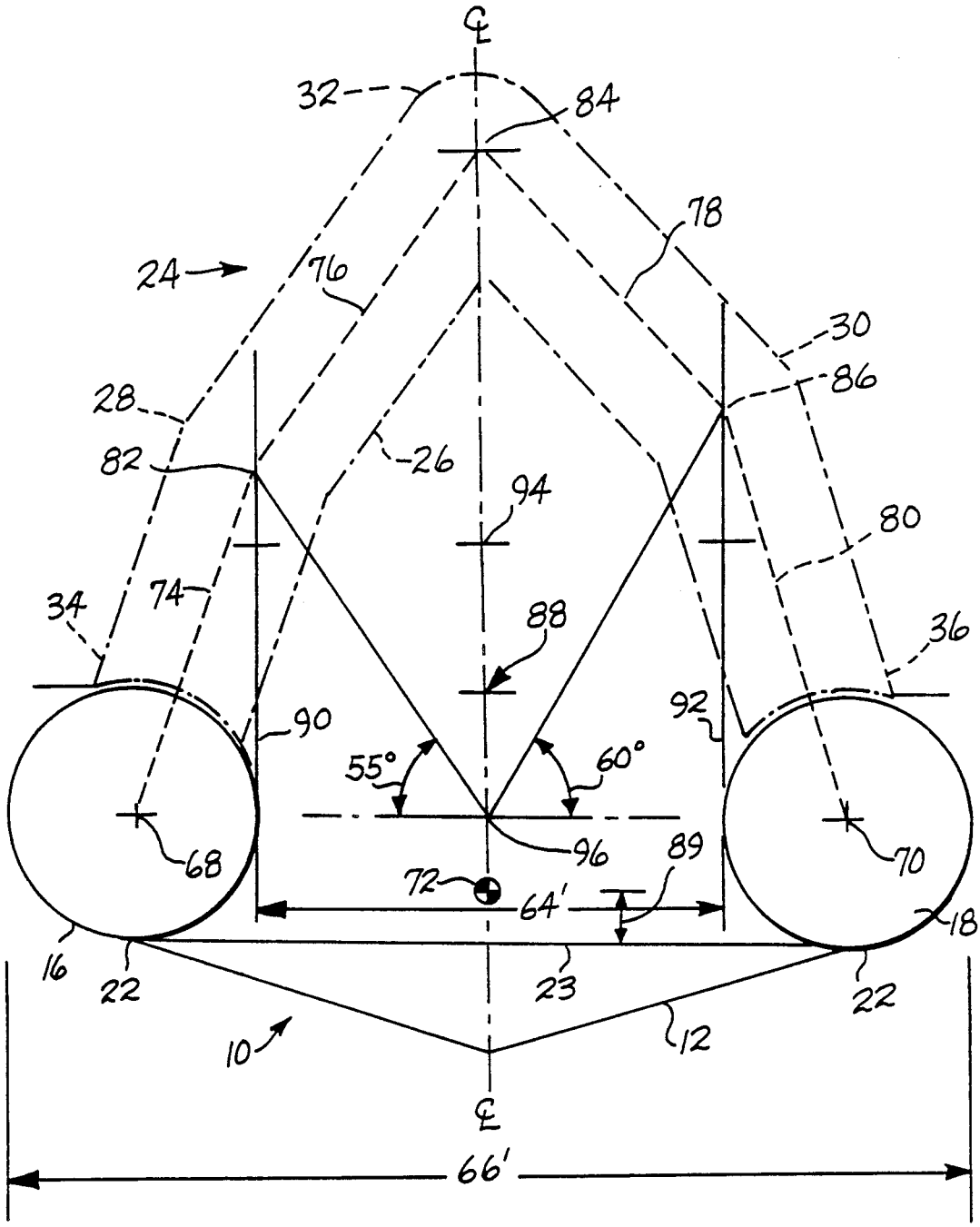
FIG. 12 is a cross-sectional schematic representation illustrating the angular specifications for construction of a second embodiment.

Referring now also to FIGS. 11 and 12, therein are shown schematic representations by which the exact shape and position of the arch member 26 is determined for any boat of a given size and weight with a determinable center of gravity. FIGS. 11 and 12 each represent a cross-section of a RIB at the location of the self-righting apparatus of the present invention. The general construction of RIBs falls into either of two basic categories. Type A is represented in FIG. 11 as being a RIB in which the interior beam 64 or distance between interior edges of the inflatable sidewalls 16, 18 is greater than 52% of the outer beam 66 of the RIB. FIG. 12 schematically represents Group B in which the interior beam 64' is less than 52% of the outer beam 66, It may be noted that the overall beam 66, 66' in each of the illustrated embodiments of Group A and Group B is the same. The interior beam 64, 64' is affected by the diameter of the inflatable sidewall tubes 16, 18. As the diameter of sidewall tubes 16, 18 increases for RIBs of a given beam, the interior distance 64, 64' between inner edges of the sidewall tubes 16, 18 decreases, as does the distance between longitudinal central axis 68, 70 of the sidewall tubes 16, 18. Likewise, as sidewall tube diameter increases, the distance between the longitudinal central axis 68, 70 to the bottom edge 22 or deck 23 level also increases. Each of these factors will contribute to variations in the resulting size and shape of the inflatable arch member 26 of the self-righting apparatus 24.

As mentioned above, it should be noted that the inflatable arch member can be constructed symmetrically about a longitudinal centerline and be fully functional according to all necessary aspects of the present invention. However, it is preferred that the inflatable arch member 26 be asymmetrically constructed to assist in creating an earlier roll during initial inflation.

The center of gravity of a boat is generally determinable upon the initial designing of the boat. The position of the center of gravity may change as equipment is added to the boat's basic structure. For example, the addition of a motor at or near the stern will tend to move the center of gravity aftward. While the addition of an outboard motor could tend to raise the center of gravity, the addition of an inboard engine would often tend to lower it. The cross-sectional vertical and lateral position of the center of gravity is indicated at 72 in FIGS. 11 and 12. The longitudinal location of the center of gravity in a RIB is typically at or slightly aft of its longitudinal midpoint. For the purpose of determining the size and shape of the inflatable arch member 26 of the present invention, it is not important at which longitudinal station the center of gravity may be located. It is important, however, that the inflatable arch member 26 of the self-righting apparatus 24 be located at or aft of the longitudinal center of gravity. In preferred form, the apparatus 24 is located at an extreme aft position, at or near the stern 14.

Typically, the center of gravity 72 is located at or only slightly above the deck 23 or level of the lower edge 22 of the sidewall tubes 16, 18. In the illustrated diagrams, the floor or deck 23 is illustrated at the level of the lower edges 22. The size and shape of the inflatable arch member 26 is determined by first locating an axial centerline of each leg 28, 30. This axial centerline is comprised of essentially four portions 74, 76, 78, 80, which extend between five predetermined points 68, 82, 84, 86, 70. Each of these points 68, 82, 84, 86, 70 is located in a common plane which represents a cross-section along a station of the boat 10. An upper central point 84 is positioned a distance above the level 88 of the sidewall's upper edge a distance substantially equal to one-half of the beam 66, 66' of the boat plus the distance 90 that the center of gravity 72 is located above the level of the lower edge 22 of the sidewall tubes 16, 18. This distance 90 represents the distance above the floor 23 at which the center of gravity 72 may be found. In some situations, this distance may be zero if the center of gravity 72 is at the vertical level of the sidewall tubes, bottom edge 22. In the event that the center of gravity 72 is located below the sidewall tubes, bottom edge 22, the distance 90 is still considered to be zero.

Once the central point 84 has been located, the interim points 82, 86 may be located. Each of the interim points 82, 86 is positioned substantially vertically above the inner edge of the sidewall tubes 16, 18. This lateral position is indicated in FIGS. 11 and 12 by a vertical line at 90, 92. The axial centerline 74, 76; 78, 80 of each leg 28, 30 is bowed or angled outwardly to intersect the vertical line 90, 92 substantially above the inner edge of each sidewall tube 16, 18 at a position which is vertically above the level of the lower edge 22 at least 50% of the distance between the vertical level of the lower edge 22 and the vertical level of the upper central point 84. This 50% point between the level of the lower edge 22 and upper central point 84 is indicated at 94. It can be seen that, in following these specifications, in no event will the axial centerline 74, 76, 78, 80 of each leg portion be completely linear, but rather will bow outwardly at an interim "knee" position.

The lower portions of the axial centerlines 74, 80 extend from these interim points 82, 86 toward the axial centerline 68, 70 of each sidewall tube 16, 18, respectively. As previously discussed, the inflatable arch member 26 terminates at lower ends 34, 36 which are typically unattached, or at least not in communication with the air chambers of the sidewall tubes 16, 18. This axial centerline 74, 80, nevertheless, determines the angular direction and position of the lower portions 34, 36 of the inflatable arch member 26.

It may be seen that a fully-functioning apparatus 24 may be constructed by determining an axial centerline of each leg portion 28, 30 along an arc which passes through either sidewall tube axis 68, 70 and the upper central point 84, where the arc has a radius equal to the distance between these two points, respectively. Such an embodiment is not illustrated, but it may be readily seen that an axial centerline established along such an arc would always cross the lateral line 90, 92, extending upwardly from the inner edge of each sidewall tube 16, 18, at or above the midpoint 94 between the upper central point 84 and the lower edges 22.

Referring now to FIG. 11, therein is shown a schematic representation of a Group A type RIB in cross-section. As previously explained, Group A will include RIBs in which the distance 64 between inner surfaces of the sidewall tubes 16, 18 is at least 52% of the overall beam 66. According to this embodiment, the shape and position of the inflatable arch member 26 is determined by the following factors, measurements and calculations.

In the illustrated example, the center of gravity 72 is determined to be somewhat above the level of the lower edge 22 of the sidewall tubes 16, 18 and slightly below the level 96 of the diametric center or longitudinal centerline 68, 70 of the sidewall tubes 16, 18. The center of gravity 72, as is virtually always the case, is located along the midship centerline (labeled as CL). The upper central point 84 is located by determining one-half of the beam 66, or distance from centerline to outside edge of either sidewall tube 16, 18, and adding to that measurement, the distance 89 above the level of the bottom edge 22 at which the center of gravity 72 is located. The resulting sum is measured upwardly along the centerline CL from the shear line or level 88 of the top edges of the sidewall tubes 16, 18. In other words, the distance between reference points 88 and 84 is equal to one-half the beam 66 plus the distance 90 at which the center of gravity 72 is located above the level of the sidewall tubes' bottom edge 22.

Next, vertical lines 90, 92 may be positioned to extend substantially straight up from interior edges of the sidewalls tubes 16, 18. These lines 90, 92 should be substantially parallel, spaced apart a distance 64. The exact location of interim points 82 and 86 are determined by the point of intersection along vertical lines 90 and 92 from an angle relatively above horizontal having its vertex midship at the level 96 of the diametric center or longitudinal central axis 68, 70 of the sidewall tubes 16, 18. The preferred angle for Group A type RIBs has been determined through experimentation to be from between approximately 45° and approximately 50°. In other words, the vertical distance at which interim points 82, 86 are spaced above the level 96 of the diametric center 68, 70 of the sidewall tubes is determined by multiplying one-half of the distance 64 between inner surfaces of the sidewall tubes 16, 18 times the tangent of the selected angle in degrees. Specifically, the tangent of 45° and the tangent of 50° is multiplied by one-half the interior width 64 to determine the spacing of interim points 82 and 86, respectively, above the level of line 96. In the illustrated schematic embodiment shown in FIG. 11, opposite extremes of this range are used in order to produce an asymmetric shape of the inflatable arch member 26. It will be noted that the specified angles will create an intersecting point 82, 86 above the halfway level 94 between the deck 23 or bottom edge 22 of the sidewall tubes 16, 18, and the upper central point 84. As previously described, imaginary lines 74, 76, 78, 80 representing the axial center of the leg portions 28, 30 of the arch member 26 are determined between these points 68, 82, 84, 86, 70.

In the schematically illustrated embodiment of FIG. 11, the starboard side, or that side at which the interim point 86 is determined by a 50° angle, will tend to cause the starboard leg 30 of the inflatable arch member 26 to lift that side of the boat 10 from the water first. This is because the buoyant force is positioned at a greater distance from the center of gravity 72, providing an increased moment arm which, in turn, creates an increased lifting torque. As previously stated, the apparatus 24 is fully capable of functioning when the inflatable arch 26 is constructed symmetrically. However, the preferred design utilizes the asymmetry to increase the speed of self-righting.

Referring now to FIG. 12, therein is shown schematically an illustration of an embodiment of the invention applied to a RIB 10 which is dimensioned to be included in Group B. A RIB in Group B is one in which the interior distance 64' between inner edges of the sidewall tubes 16, 18 is no more than 52% of the RIB's overall beam 66'. As the calculations by which the shape and position of the inflatable arch member 26 for Group B is in most respects substantially identical to that for Group A, the following description and analysis for Group B will be somewhat abbreviated.

To determine the location of the upper central point 84, a measurement is taken to determine one-half of the overall beam 66' of the RIB 10. To that measurement is added the distance 89 above the deck 23 or level of the bottom edges 22 of the sidewall tubes 16, 18 at which the center of gravity 72 has been determined. This sum represents the distance above the shear line or level 88 of the upper edges of the sidewall tubes 16, 18 at which the upper central point 84 is located. Interim points 82, 86 of the leg portions 28, 30 are determined by the intersection of an angle from between approximately 55° and approximately 60° from horizontal having its vertex midship at the level 96 of the diametric centers 68, 70 of the sidewall tubes 16, 18 with vertical lines 90, 92 extending substantially upwardly from inner edges of the sidewall tubes 16, 18. As explained above with respect to Group A, the vertical distance at which interim points 82 and 86 are spaced above line 96 may be determined by multiplying one-half the interior measurement 64' times the tangent of 55° and the tangent of 60°, respectively. As can be readily seen from the schematic illustration in FIG. 12, these intersecting locations 82, 86 are vertically above the level 94 of midpoint between the deck 23 or bottom edges 22 of the sidewall tubes 16, 18 and the upper central point 84. The angular range of 55° to 60° has been determined by experimentation to be the preferred range.

The relatively increased diameter of the sidewall tubes 16, 18 in Group B RIBs causes the relative ratio of the interior beam width 64' to the overall beam 66, to decrease and causes the level 96 of the diametric center or axial centerlines 68, 70 from the deck 23 or lower edges 22 to be increased. In this situation, the relatively smaller angles which have been determined to be preferred for use with Group A are unacceptable and would result in the interim leg points 82, 86 falling below the midpoint line 94. This would cause the leg portions 28, 30 of the inflatable arch 26 to be substantially straight or to have insufficient outward bow. Such an arrangement would not provide adequate buoyant force at a sufficient distance from the center of gravity 72 to create the necessary self-righting torque lift.

As explained above, the above calculations determine only points through which an imaginary or calculated axial centerline 74, 76, 78, 80 of the inflatable arch. The exact size, i.e. diameter, of the arch member 26, as shown in phantom in FIGS. 11 and 12, is determined by the overall weight of the RIB fully equipped. The total volume of the inflatable arch 26 must be sufficient to displace a mass of water equal to that of the boat. This calculation may easily be made by one skilled in the art on the basis that one cubic foot of seawater equals sixty-four pounds in weight. For example, a RIB having an overall length of sixteen feet, six inches may have a beam of approximately eight feet with twenty inch diameter sidewall tubes. Such a RIB would be classified as a Group A RIB, as the interior width of fifty-six inches is greater than 52% of the beam. If the fully-equipped weight of such a RIB is determined to be from between 850 pounds to 950 pounds, the legs of the inflatable arch could be made at approximately seventeen inches in diameter creating slightly over fifteen cubic feet or approximately 977 pounds of displacement. It should be noted that larger, fully-outfitted RIBs, including strapped-in crew members, could easily exceed 6,000 pounds in weight. The disclosed apparatus will self-right any RIB of any weight so long as it is constructed according to the present invention. It is not necessary that the legs of the inflatable arch member be round in cross-section, although that is the preferred shape to provide maximum volume with minimum material. Whatever the chosen shape, it should be positioned such that its axial centerline is aligned with that which is determined according to the present invention. It is preferred that the arch member have a uniform cross-sectional diameter. Although increased displacement for added buoyancy could be utilized, buoyancy should not be decreased at other locations on the arch.

The "bow legged" arch design of the present invention facilitates not only righting of the RIB upon initial inflation, but also, because of the shape and position of the arch legs, prevents subsequent capsizing of the RIB beyond 90° from normal. As previously discussed, this is in contrast to prior art righting systems for RIBs which could allow the RIB to be held in a lifted, but inverted, position upon initial inflation or could allow the RIB to rest on its side upon subsequently overturning. Furthermore, this is accomplished without having any portion of the arch member 26 extend outwardly beyond the beam 66, 66' of the RIB 10.

As explained above, many variations in the exact size, shape and position of the apparatus of the present invention could be made without departing from its spirit or scope, or diminishing its general utility. For this reason, my patent protection is not to be limited in any way by the disclosed and illustrated preferred embodiments or examples, but rather only by the following claim or claims interpreted according to accepted doctrines of claim interpretation, including the doctrine of equivalents.

What is claimed is:

1. An apparatus for self-righting a rigid inflatable boat, comprising:

an elongated boat hull having a determinable center of gravity and beam and having an elongated rigid bottom and inflatable sidewalls, said sidewalls having top, bottom and inner edges;

an inflatable arch member having first and second leg portions extending upwardly and inboard from opposite sidewalls of said hull and converging at a central point spaced upwardly a first predetermined vertical distance above said top edges;

said first predetermined distance being at least equal to the sum of one-half of the beam of the hull plus a distance equal to a vertical distance at which said center of gravity is located above said sidewalls' bottom edges; and each said leg portion having an axial centerline which extends upwardly and inwardly substantially between its respective sidewall and said central point, each said axial centerline passing vertically above said inner edge of its respective sidewall at a vertical level above said bottom edge a distance equal to at least one-half of the vertical distance between said central point and said bottom edge;

said inflatable arch member being sized to have an overall width substantially not greater than the beam of said boat and to provide a total displacement sufficient to lift said boat, said arch member being positioned along said elongated boat hull aft of said center of gravity.

2. The apparatus of claim 1, further comprising a frame means for rigidly supporting said inflatable arch member in a position substantially vertical relative to said elongated boat hull.

3. The apparatus of claim 1, wherein said first and second leg portions of said inflatable arch member are asymmetrical, one said leg portion having an axial centerline which passes vertically above said inner edge of its respective sidewall at a vertical level slightly higher than that of the other.

4. The apparatus of claim 1, wherein each said leg portion is substantially circular in cross-section and wherein each said leg portion is substantially uniform in cross-section along its axial centerline.

5. An apparatus for self-righting a rigid inflatable boat in which said boat has an elongated hull with an elongated rigid bottom and inflatable sidewalls in which an interior measurement between said inflatable sidewalls is at least 52% of its beam, said apparatus comprising:

an inflatable arch member having first and second leg portions extending upwardly and inwardly substantially from opposite sidewalls of said hull and converging at a central point spaced above said hull;

said elongated boat hull having a determinable center of gravity and said sidewalls having top, bottom and inner edges and each having an axial centerline;

said central point being spaced vertically above said top edges a distance equal to at least the sum of one-half the beam of the hull plus a distance equal to a vertical distance at which said center of gravity is located above said sidewalls' bottom edges;

each said leg portion having an axial centerline which extends upwardly and inwardly substantially in line between the axial centerline of its respective sidewall and a predetermined interim point located at a position which is laterally positioned substantially above the inner edge of said sidewall and vertically above the axial centerline of said sidewall a distance substantially equal to the product of distance Y times (tan X), where:

Y = one-half the interior measurement between said inflatable sidewalls, and $X \geqq$ to 45°;

said predetermined interim point in no event being higher than said central point;

said axial centerline of said arch member's leg portion then extending upwardly and inwardly in line to said central point; and said inflatable arch member being sized to provide a total displacement sufficient to lift said boat and being positioned along said elongated boat hull at a position aft of said center of gravity.

6. The apparatus of claim 5, wherein the angle X for determination of said interim point for said second leg portion is approximately 5° greater than that for said first leg portion.

7. An apparatus for self-righting a rigid inflatable boat in which said boat has an elongated hull with an elongated rigid bottom and inflatable sidewalls in which an interior measurement between said inflatable sidewalls is not more than 52% of its beam, said apparatus comprising:

an inflatable arch member having first and second leg portions extending upwardly and inwardly substantially from opposite sidewalls of said hull and converging at a central point spaced above said hull;

said elongated boat hull having a determinable center of gravity and said sidewalls having top, bottom and inner edges and each having an axial centerline;

said central point being spaced vertically above said top edges a distance equal to at least the sum of one-half the beam of the hull plus a distance equal to a vertical distance at which said center of gravity is located above said sidewalls' bottom edges;

each said leg portion having an axial centerline which extends upwardly and inwardly substantially in line between the axial centerline of its respective sidewall and a predetermined interim point located at a position which is laterally positioned substantially above the inner edge of said sidewall and vertically above the axial centerline of said sidewall a distance substantially equal to the product of distance Y times (tan X), where:

Y=one-half the interior measurement between said inflatable sidewalls, and

X≧to 55°;

said predetermined interim point in no event being higher than said central point;

said axial centerline of said arch member's leg portion then extending upwardly and inwardly in line to said central point; and said inflatable arch member being sized to provide a total displacement sufficient to lift said boat and being positioned along said elongated boat hull at a position aft of said center of gravity.

8. The apparatus of claim 7, wherein the angle X for determination of said interim point for said second leg portion is approximately 5° greater than that for said first leg portion.

* * * * *

UNITED STATES PATENT AND TRADEMARK OFFICE

CERTIFICATE OF CORRECTION

PATENT NO. : 5,056,453

DATED : October 15, 1991

INVENTOR(S) : Derek Wright

It is certified that error appears in the above-identified patent and that said Letters Patent is hereby corrected as shown below:

Col. 2, line 4, there is a period after "diameter".

Col. 6, line 5, "Figs. 71410" should be -- Figs. 7-10 --.

Col. 7, line 4, "beam 66," should be --beam 66'.--.

Col. 8, line 1, "tubes," should be -- tubes' --.

Col. 10, line 22, "beam 66," should be -- beam 66' --.

Signed and Sealed this

Thirtieth Day of March, 1993

*Attest:*

STEPHEN G. KUNIN

*Attesting Officer*

*Acting Commissioner of Patents and Trademarks*